US009889970B1

(12) United States Patent
Woody

(10) Patent No.: US 9,889,970 B1
(45) Date of Patent: Feb. 13, 2018

(54) NOVELTY GIFT CONTAINER

(71) Applicant: Phillip Woody, Normany Park, WA (US)

(72) Inventor: Phillip Woody, Normany Park, WA (US)

( * ) Notice: Subject to any disclaimer, the term of this patent is extended or adjusted under 35 U.S.C. 154(b) by 109 days.

(21) Appl. No.: 15/151,022

(22) Filed: May 10, 2016

(51) Int. Cl.

| | |
|---|---|
| ***B65D 75/00*** | (2006.01) |
| ***B65D 33/00*** | (2006.01) |
| ***B65D 85/00*** | (2006.01) |
| ***B65D 33/16*** | (2006.01) |
| ***B65D 33/28*** | (2006.01) |

(52) U.S. Cl.
CPC ..... *B65D 33/004* (2013.01); *B65D 33/16* (2013.01); *B65D 33/28* (2013.01); *B65D 85/70* (2013.01)

(58) Field of Classification Search
USPC ..... 206/457, 459.5
See application file for complete search history.

(56) References Cited

U.S. PATENT DOCUMENTS

| | | | | |
|---|---|---|---|---|
| 1,872,640 | A * | 8/1932 | Pink | B65D 31/12 206/315.9 |
| 2,085,365 | A * | 6/1937 | Israel | B65D 33/02 206/461 |
| D252,386 | S | 7/1979 | Onderdonk | |
| 5,050,999 | A | 9/1991 | Van Loon, III | |
| 5,551,570 | A | 9/1996 | Shaffer | |
| 5,683,769 | A | 11/1997 | Cheng | |
| 6,092,932 | A | 7/2000 | Pekala | |
| 6,241,389 | B1 | 6/2001 | Gilmore | |
| D503,883 | S | 5/2003 | Cox | |
| D542,151 | S | 5/2007 | Sutton | |
| 2004/0084345 | A1* | 5/2004 | Alonso | G09F 23/00 206/457 |
| 2005/0082177 | A1* | 4/2005 | Weiss | B65D 51/18 206/217 |
| 2005/0092629 | A1* | 5/2005 | Choi | B65D 43/0212 206/308.1 |
| 2005/0205437 | A1* | 9/2005 | Huffman | B65D 1/265 206/217 |
| 2006/0032782 | A1* | 2/2006 | Suh | A45C 7/0086 206/581 |
| 2007/0029222 | A1* | 2/2007 | Shepardson | B44C 5/06 206/457 |
| 2007/0084743 | A1* | 4/2007 | Chu | A47G 1/14 206/455 |
| 2007/0281113 | A1 | 12/2007 | Hensley | |
| 2008/0190945 | A1* | 8/2008 | Milnark | A47G 19/2211 220/709 |
| 2014/0311936 | A1* | 10/2014 | Marks | B65D 25/34 206/457 |
| 2015/0034515 | A1* | 2/2015 | Monyak | B25H 3/02 206/349 |

* cited by examiner

*Primary Examiner* — Jacob K Ackun
(74) *Attorney, Agent, or Firm* — Kyle A. Fletcher, Esq.

(57) ABSTRACT

The novelty gift container is a container that is adapted for use in containing and transporting objects. The novelty gift container is decorated with a plurality of motivational symbols and a plurality of instructional messages that, in concert with the object contained within the novelty gift container, are intended to improve the psychological state of a person receiving the novelty gift container. The novelty gift container comprises a container, a plurality of motivational symbols, and a plurality of instructional messages.

12 Claims, 2 Drawing Sheets

NOVELTY GIFT CONTAINER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of containers for storage and transportation, more specifically, a container with messages printed on the exterior of the container and members projecting away from the plane of the container.

SUMMARY OF INVENTION

The novelty gift container is a container that is adapted for use in containing and transporting objects. The exterior of the novelty gift container is decorated with a plurality of motivational symbols and a plurality of instructional messages that, in concert with the object contained within the novelty gift container, are intended to improve the psychological state of a person receiving the novelty gift container.

These together with additional objects, features and advantages of the novelty gift container will be readily apparent to those of ordinary skill in the art upon reading the following detailed description of the presently preferred, but nonetheless illustrative, embodiments when taken in conjunction with the accompanying drawings.

In this respect, before explaining the current embodiments of the novelty gift container in detail, it is to be understood that the novelty gift container is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the novelty gift container.

It is therefore important that the claims be regarded as including such equivalent construction insofar as they do not depart from the spirit and scope of the novelty gift container. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
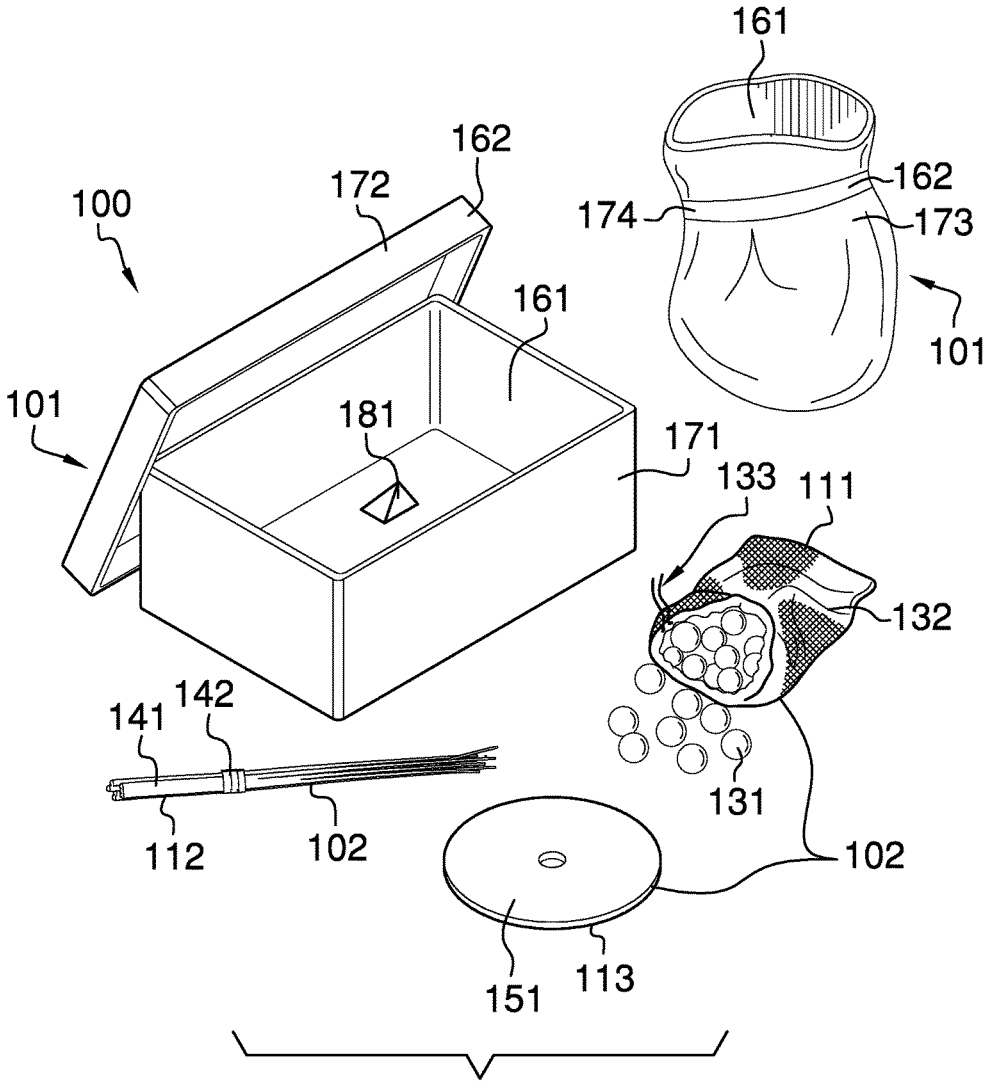
FIG. 1 is a perspective view of an embodiment of the disclosure.
Figure 2:
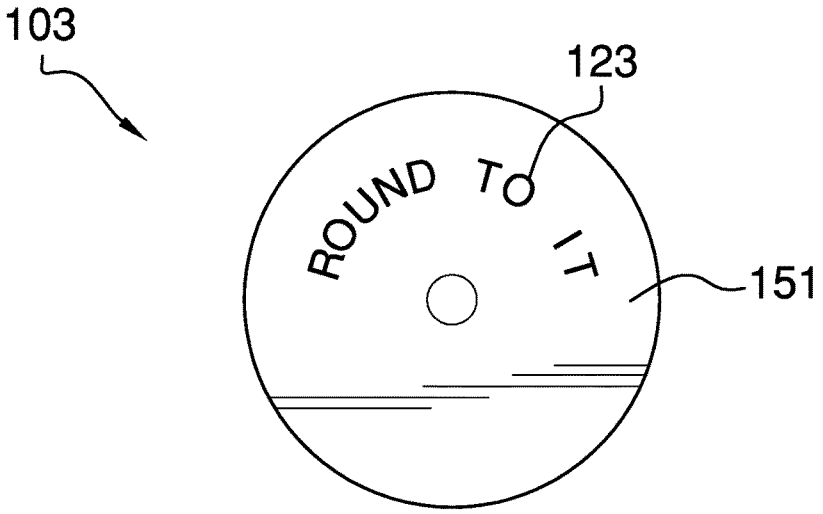
FIG. 2 is a detail view of an embodiment of the disclosure.
Figure 3:
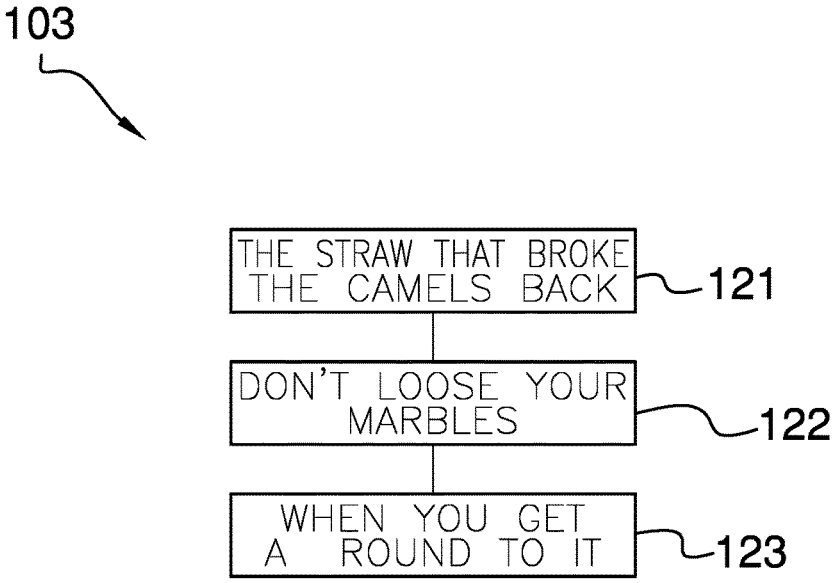
FIG. 3 is a detail view of an embodiment of the disclosure.

Detailed reference will now be made to one or more potential embodiments of the disclosure, which are illustrated in FIGS. 1 through 3.

The novelty gift container 100 (hereinafter invention) comprises a container 101, a plurality of motivational symbols 102, and a plurality of instructional messages 103. The invention 100 is a container 101 that is adapted for use in containing and transporting objects. The invention 100 is decorated with the plurality of motivational symbols 102 and a plurality of instructional messages 103 that, in concert with the object contained within the invention 100, are intended to improve the psychological state of a person receiving the invention 100.

The container 101 is used to hold a first object 181 that in general is intended as a gift for the recipient. The container 101 further comprises an opening 161 and a container closure 162. The first object 181 is inserted into the container 101 through the opening 161 after which the first object 181 is secured in the container 101 by blocking access to the opening 161 using the container closure 162. The methods to design, fabricate, and use containers 101 with openings 161 and closures 162 are well known and documented in the mechanical and decorative arts.

Each of the plurality of motivational symbols 102 comprises a second object that is attached to the exterior of the container 101. It is preferred, but not necessary, that the second object have cultural or personal significance for the recipient. Methods to attach each of the plurality of motivational symbols 102 to exterior of the container 101 are well known in the decorative arts and include, but are not limited to, the use of commercially available staples or the use of an adhesive.

Each of the plurality of instructional messages 103 contains an image that conveys a message to the recipient. It is preferred, but not necessary, that each of the plurality of instructional messages 103 convey a message of cultural or personal significance for the recipient. Each of the plurality of instructional messages 103 is displayed on the either the exterior of the container 101 or on a motivational symbol selected from the plurality of motivational symbols 102.

In the first potential embodiment of the disclosure, the plurality of motivational symbols 102 further comprises a first motivational symbol 111, a second motivational symbol 112, and a third motivational symbol 113. The plurality of instructional messages 103 further comprises a first instructional message 121, a second instructional message 122, and a third instructional message 123.

In the first potential embodiment of the disclosure, as shown most clearly in FIGS. 1 through 3, the first motivational symbol 111 comprises a plurality of marbles 131, a net bag 132 and a net bag closure 133. The plurality of marbles 131 are contained within the net bag 132. The net bag closure 133 is a commercially available device that is used to close the net bag 132. The second motivational symbol 112 comprises a plurality of straws 141 and a tie 142. The tie 142 is a cord that is used to gather and secure the plurality of straws 141. The third motivational symbol 113 comprises a circular disk 151. The circular disk 151 is a disk shaped structure upon which are displayed in a visible manner each of the plurality of instructional messages 103. The first instructional message 121 comprises the printed textual message "The Straw That Broke the Camel's Back." The second instructional message 122 comprises the printed textual message "Don't Lose Your Marbles." The third instructional message 123 is the printed textual message "When You Get Round to It."

A second potential embodiment of the disclosure is an extension of the first potential embodiment of the disclosure wherein the container 101 further comprises a first rectangular block 171 and a second rectangular block 172. The first rectangular block 171 is a hollow rectangular block with a face removed such that the first object 181 can be placed within the hollow interior of the first rectangular block 171. The second rectangular block 172 is a hollow rectangular block with a face removed such that the second rectangular block 172 can be placed over the first rectangular block 171. The inner dimensions of the open face of the second rectangular block 172 is larger than the outer dimensions of the corresponding open face of the first rectangular block 171 such that the second rectangular block 172 will enclose the hollow interior of the first rectangular block 171 when the second rectangular block 172 is placed over the open face of the first rectangular block 171. In the second potential embodiment of the disclosure, the opening 161 is formed by the open face of the first rectangular block 171 while the container closure 162 is formed by the second rectangular block 172.

A second potential embodiment of the disclosure is an extension of the first potential embodiment of the disclosure wherein the container 101 further comprises a gift bag 173 and a ribbon 174. The ribbon 174 is a textile strap that is used to wrap around the opening 161 of the gift bag 173 in order to secure the opening 161.

To use the invention 100, the first object 181 is placed through the opening 161 into the container 101. The opening 161 is then closed using the container closure 162. The invention 100 is then given to the recipient.

The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Bag: As used in this disclosure, a bag is a container made of a flexible material. The bag has a single opening which allows the bag to receive the items to be contained.

Cord: As used in this disclosure, a cord is a long, thin, and flexible piece of string, line, or rope. Cords are made from yarns, piles, or strands of material that are braided or twisted together or from a monofilament (such as fishing line). Cords have tensile strength but are too flexible to provide compressive strength and are not suitable for use in pushing objects. String, line, and rope are synonyms for cord.

Correspond: As used in this disclosure, the term correspond means that a first object is in some manner linked to a second object in a one to one fashion.

Inner Dimension: As used in this disclosure, the term inner dimension describes the span from a first inside or interior surface of a container to a second inside or interior surface of a container. The term is used in much the same way that a plumber would refer to the inner diameter of a pipe.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Strap: As used in this disclosure a strap is a strip of leather, cloth, or other flexible material, often with a buckle, that is used to fasten, secure, carry, or hold onto something.

Strip: As used in this disclosure, the term describes a long and narrow object of uniform thickness that appears thin relative to the length of the object. Strips are often rectangular in shape.

With respect to the above description, it is to be realized that the optimum dimensional relationship for the various components of the invention described above and in FIGS. 1 through 3, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A novelty gift container comprising:

a container, a plurality of motivational symbols, and a plurality of instructional messages;

wherein the container that is adapted for use in containing and transporting objects;

wherein the container is adapted to receive a first object;

wherein the container comprises an opening and a container closure;

wherein the first object is inserted into the container through the opening;

wherein each of the plurality of motivational symbols comprises a second object;

wherein the second object is attached to the exterior of the container;

wherein each of the plurality of instructional messages is an image;

wherein the image is intended to convey a message;

wherein each of the plurality of instructional messages is visible from the exterior of the container;

wherein the plurality of motivational symbols further comprises a first motivational symbol, a second motivational symbol, and a third motivational symbol;

wherein the first motivational symbol comprises a plurality of marbles, a bag, and a bag closure;

wherein the plurality of marbles are stored within the bag;

wherein the bag closure secures the plurality of marbles in the bag;

wherein the second motivational symbol comprises a plurality of straws and a tie;

wherein the tie is a cord that is used to gather and secure the plurality of straws;

wherein the third motivational symbol is a disk;

wherein the plurality of instructional messages further comprises a first instructional message, a second instructional message, and a third instructional message;

wherein the first instructional message comprises the printed textual message "The Straw That Broke the Camel's Back;"

wherein the second instructional message comprises the printed textual message "Don't Lose Your Marbles;"

wherein the third instructional message is the printed textual message "When You Get Round to It".

2. The novelty gift container according to claim 1 wherein the container further comprises a first rectangular block and a second rectangular block;

wherein the second rectangular block fits over the first rectangular block.

3. The novelty gift container according to claim 2 wherein the first rectangular block is a hollow rectangular block with an open face;

wherein the second rectangular block is a hollow rectangular block with an open face.

4. The novelty gift container according to claim 3 wherein the inner dimensions of the open face of the second rectangular block is larger than the outer dimensions of the open face of the first rectangular block such that the second rectangular block will enclose the hollow interior of the first rectangular block when the second rectangular block is placed over the open face of the first rectangular block.

5. The novelty gift container according to claim 1 wherein the container further comprises a gift bag and a ribbon;

wherein the ribbon is a textile strap that is used to wrap around the opening of the gift bag in order to secure the first object in the gift bag.

6. The novelty gift container according to claim 1 wherein one or more messages selected from the plurality of the instructional messages are displayed on one or more motivational symbols selected from the plurality of instructional symbols.

7. The novelty gift container according to claim 6 wherein the plurality of motivational symbols further comprises a first motivational symbol, a second motivational symbol, and a third motivational symbol;

wherein the first motivational symbol comprises a plurality of marbles, a bag, and a bag closure;

wherein the plurality of marbles are stored within the bag;

wherein the bag closure secures the plurality of marbles in the bag;

wherein the second motivational symbol comprises a plurality of straws and a tie;

wherein the tie is a cord that is used to gather and secure the plurality of straws;

wherein the third motivational symbol is a disk.

8. The novelty gift container according to claim 7 wherein the plurality of instructional messages further comprises a first instructional message, a second instructional message, and a third instructional message;

wherein the first instructional message comprises the printed textual message "The Straw That Broke the Camel's Back;"

wherein the second instructional message comprises the printed textual message "Don't Lose Your Marbles;"

wherein the third instructional message is the printed textual message "When You Get Round to It".

9. The novelty gift container according to claim 8 wherein the container further comprises a first rectangular block and a second rectangular block;

wherein the second rectangular block fits over the first rectangular block.

10. The novelty gift container according to claim 9 wherein the first rectangular block is a hollow rectangular block with an open face;

wherein the second rectangular block is a hollow rectangular block with an open face.

11. The novelty gift container according to claim 10 wherein the inner dimensions of the open face of the second rectangular block is larger than the outer dimensions of the open face of the first rectangular block such that the second rectangular block will enclose the hollow interior of the first rectangular block when the second rectangular block is placed over the open face of the first rectangular block.

12. The novelty gift container according to claim 8 wherein the container further comprises a gift bag and a ribbon;

wherein the ribbon is a textile strap that is used to wrap around the opening of the gift bag in order to secure the first object in the gift bag.

* * * * *